US008193462B2

(12) United States Patent
Zanini et al.

(10) Patent No.: US 8,193,462 B2
(45) Date of Patent: Jun. 5, 2012

(54) PUSH BUTTON SWITCH FOR A VEHICLE DOOR PANEL

(75) Inventors: Paolo Zanini, Arona (IT); Damiano Valfredini, Borgomanero (IT)

(73) Assignee: Zanini S.p.A. (IT)

( * ) Notice: Subject to any disclaimer, the term of this patent is extended or adjusted under 35 U.S.C. 154(b) by 356 days.

(21) Appl. No.: 12/512,850

(22) Filed: Jul. 30, 2009

(65) Prior Publication Data

US 2011/0024271 A1 Feb. 3, 2011

(51) Int. Cl.
*H01H 9/00* (2006.01)

(52) U.S. Cl. ..... 200/296

(58) Field of Classification Search ..... 200/296
See application file for complete search history.

(56) References Cited

U.S. PATENT DOCUMENTS

| | | | | |
|---|---|---|---|---|
| 4,220,808 | A * | 9/1980 | Fujita | 174/490 |
| 5,308,943 | A * | 5/1994 | Screven et al. | 200/521 |
| 6,299,392 | B1 * | 10/2001 | Swanson | 408/234 |
| 6,861,602 | B2 * | 3/2005 | Juga | 200/341 |

* cited by examiner

*Primary Examiner* — Vanessa Girardi
(74) *Attorney, Agent, or Firm* — Hayes Soloway P.C.

(57) ABSTRACT

A release device, particularly for a motor vehicle door, comprises a base body intended to be applied on the outer face of a door, having an axial appendage that can be inserted in a corresponding opening of the door. The axial appendage includes a tubular portion provided with a bottom wall having a hole intended to be slidably engaged by a cylindrical member projecting axially from a button to be associated with the base body with a possibility of a relative movement. The tubular portion has connection means for allowing a switch unit to be removably fastened, which switch unit can be operated as a result of an axial movement of a free end of the cylindrical member of the button.

20 Claims, 4 Drawing Sheets

PUSH BUTTON SWITCH FOR A VEHICLE DOOR PANEL

BACKGROUND OF THE INVENTION

The present invention refers to a release device which can be used in particular to unlock a motor vehicle door.

In the present description and in appended claims the term door indicates any body panel that can be opened, such as, for example, a trunk door or a hatchback door of a car.

SUMMARY OF THE INVENTION

The main object of the invention is to made a release device provided with a simple structure and which is adapted to be operated by a user in a simple and comfortable manner.

By virtue of such features, the device of the invention is characterized by a simple structure which allows its assembly on the motor vehicle door to be made easier as a result of few simple steps, so as to make it inexpensive both to be manufactured and installed, and which allows to be operated in a practical and quick manner by a user.

Further characteristics and advantages of the invention will turn out more clearly from the following detailed description, provided as a non-limitative example and referred to the appended drawings in which:

DETAILED DESCRIPTION OF THE INVENTION

Figure 1:
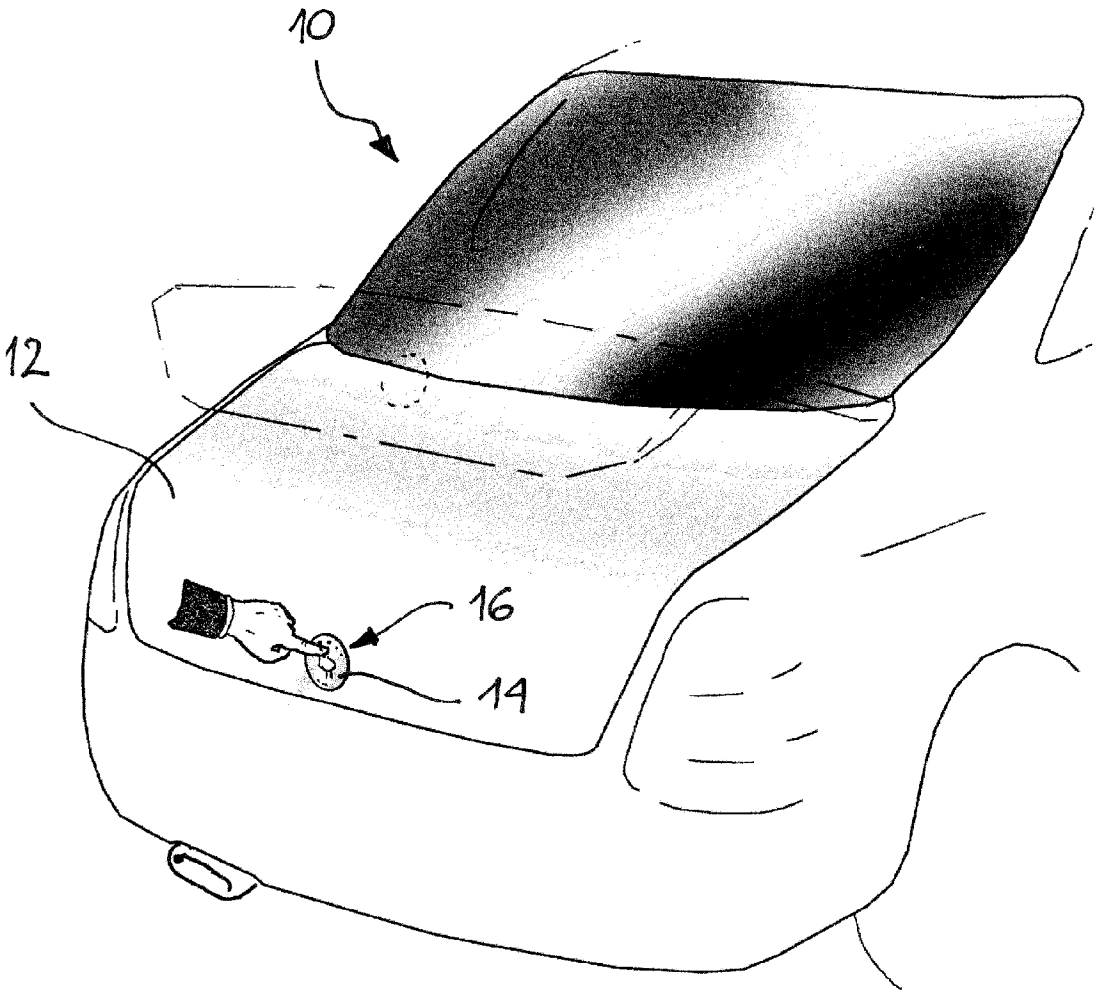
FIG. 1 is a rear perspective schematic view of a motor vehicle the trunk or hatchback door of which is provided with a release device according to the invention.
Figure 2:
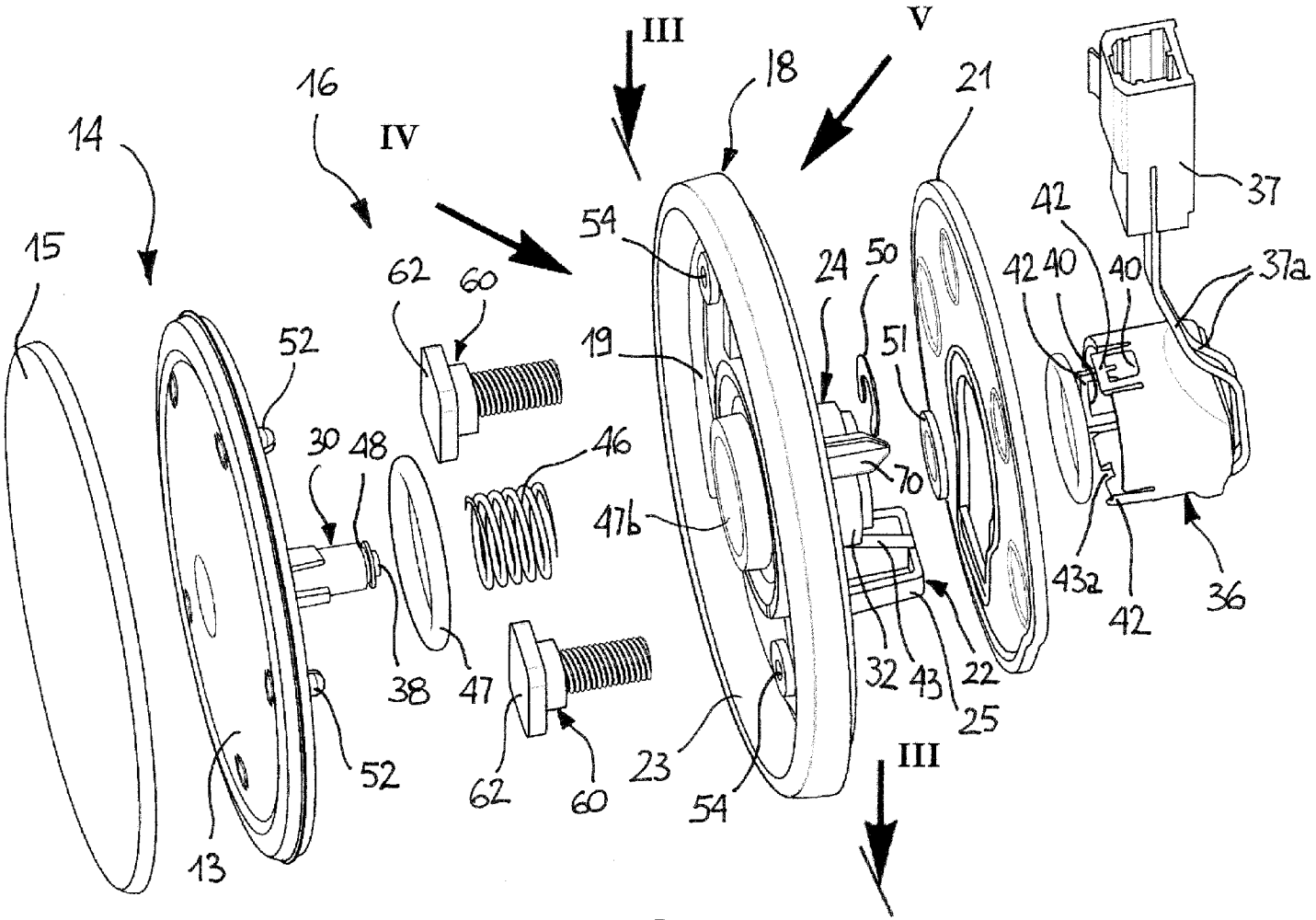
FIG. 2 is a perspective exploded view of the main component parts of the release device of FIG. 1.
Figure 3:
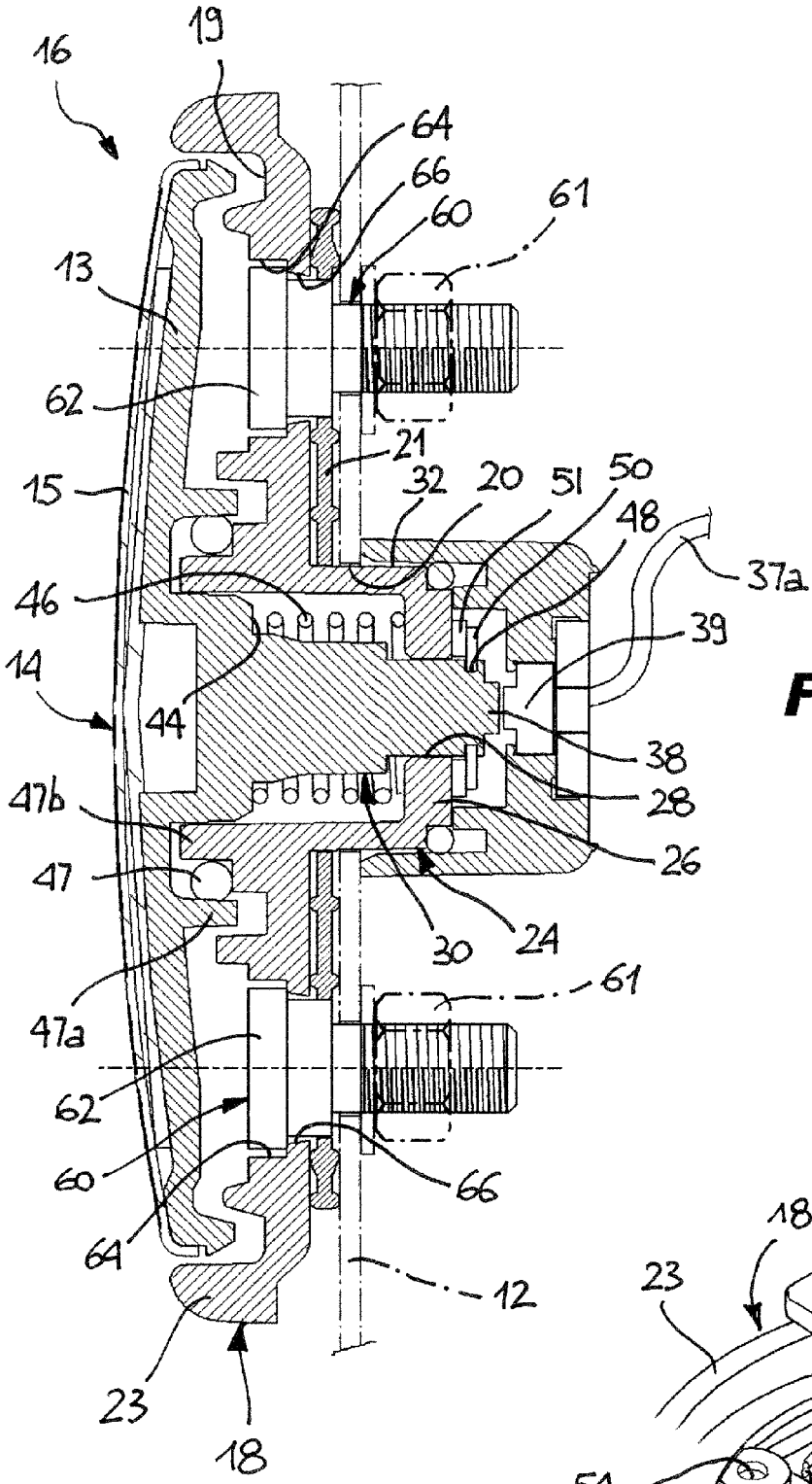
FIG. 3 is a top elevation view of the device of FIG. 2 in its assembled condition, sectioned along line III-III of FIG. 2.
Figure 4:
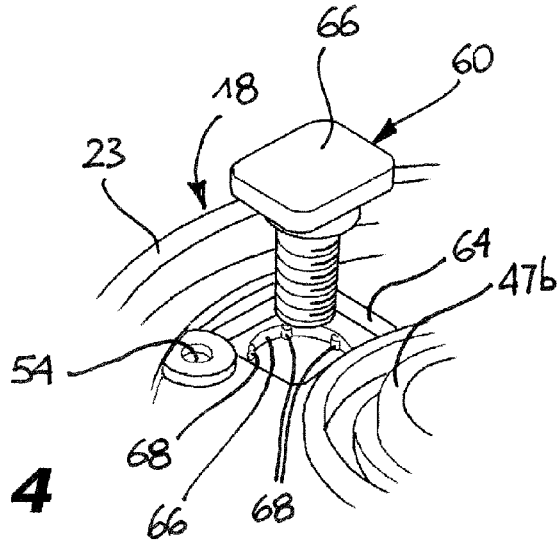
FIG. 4 is a perspective view of a detail indicated by arrow IV in FIG. 2.
Figure 6:
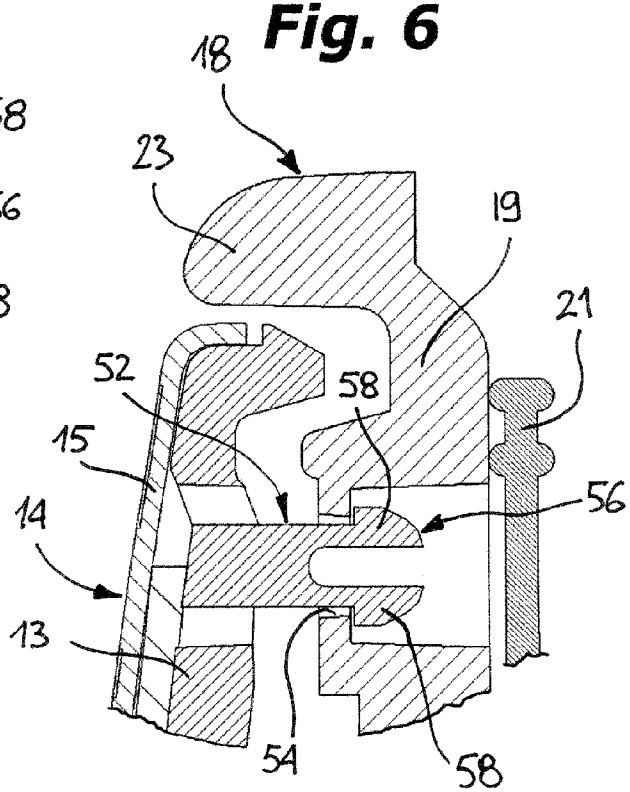
FIG. 6 is a fragmentary and side elevation view sectioned along line VI-VI of FIG. 5.
Figure 5:
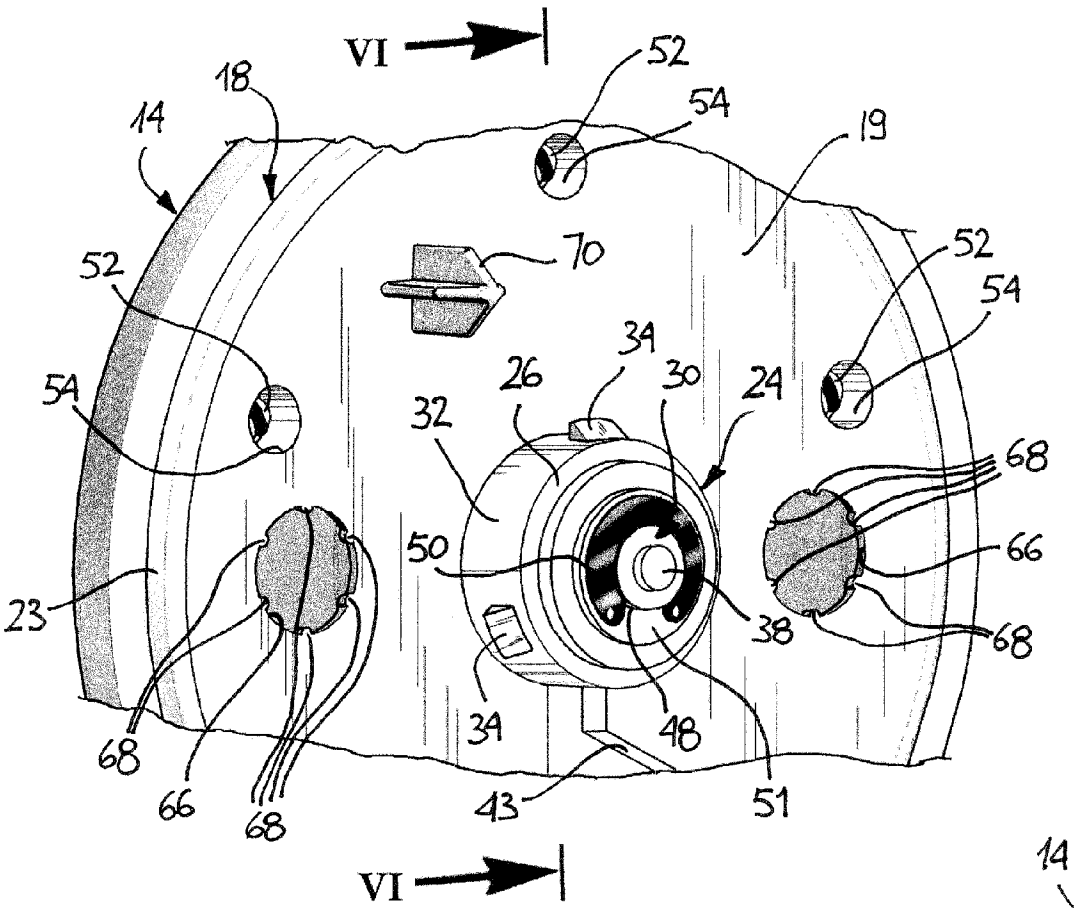
FIG. 5 is a perspective view of a detail indicated by arrow V in FIG. 2, of the partially assembled device.

With initial reference to FIG. 1, a motor vehicle 10 comprises a door that can be opened, consisting of a body panel 12 adapted to reach a closed configuration or an open configuration, which correspond to a lowered position and to a raised position (outlined in FIG. 1), respectively, in the case of the trunk or hatchback door of the motor vehicle 10.

To open the panel 12, it is necessary to unlock a locking unit of a type known per se (not shown in the figures) that, in the more general case, comprises a movable pawl adapted to engage a seat formed in the body in a position adjacent to the edge of the door 12. Releasing of the locking unit is controlled by a button 14 of a release device 16 associated with the panel 12, which button 14 can be operated by applying a pressure through a finger of a user.

With particular reference to FIGS. 2 to 6, the release device 16 comprises a base body 18, for example having a circular shape as shown in the figures, which includes a flat plate portion 19 intended to be applied in a frontal bearing on the outer face of the panel 12, with interposition of a seal 21.

An appendage 22 to be inserted in a through opening 20 having a corresponding shape and provided in the panel 12, extends from the face of the body 18 facing the panel 12, while a peripheral projection 23, which constitutes a frame of the body 18, projects from the opposite face of the body 18.

The appendage 22 includes a tubular portion 24 coaxial with the body 18, which has a transverse bottom wall 26 provided with an axial hole 28, as well as a bracket 25 adjacent to the portion 24. The hole 28 is crossed by an end portion 38 of a cylindrical member 30 which extends axially from a plate portion 13, for example disc shaped, of the button 14, facing the body 18.

Conveniently, a shaped cover member 15 is applied on the outer face of the button 14, which member preferably bears a symbol, such as a trademark, of the motor vehicle 10.

The button 14 is mounted axially movable with respect to the body 18 and to its portion 24, and is biased towards a direction of removal with respect to the flat portion 19 of the body 18. For this purpose, a helical thrust spring 46 is interposed between the bottom 26 of the tubular portion 24 and a radial shoulder 44 of the cylindrical member 30, on the side of the disc portion 13 of the button 14. An O-ring seal 47 is arranged between a coaxial collar 47*a* of the button 14 and another coaxial collar 47*b*, of a greater diameter, of the body 18, the collar 47*b* constituting an axial extension of the tubular portion 24, which extends towards the button 14.

In order to limit the axial stroke of the cylindrical body 30 with respect to the bottom wall 26, a circular groove 48 is formed close to the free end 38 of the element 30, in which groove a snap ring 50 is inserted, a washer 51 being interposed between the snap ring 50 and the bottom wall 26.

A plurality of axial pins 52, each of which is adapted to engage a corresponding hole 54 of the flat portion 19 of the body 18, extend from the disc portion 13 of the button 14 towards the body 18. Each pin 52 comprises a fork shaped head 56 including a pair of parallel and elastically deformable branches, each of which has a stop tooth 58 on its radially outer surface. The diameter of the holes 54 is smaller than the diameter of the head 56 in its unreformed condition, in such a manner that the insertion of the pins 52 in the respective holes 54 causes a radial contraction of the branches of the heads 56, which reach against the undeformed condition after having crossed the narrow zone constituted by the edge of the hole 54, so that the pins 52 constitute a pawl stop for the button 14 with respect to the body 18, with the aim of preventing the accidental removal thereof.

Connection means, which are intended to removably fasten a switch unit 36, are arranged on the outer wall 32 of the end of the tubular portion 24 opposite to the button 14. The unit 36 is defined by a cup shaped case which supports an electrical micro-switch 39 connected by a pair of conductors 37*a* to a female electrical connector 37 of a type known per se, which is adapted to receive a complementary male connector (not shown) with the aim of connecting the unit 36 to a driving electric motor for driving the aforesaid locking unit.

The micro-switch 39, in the assembled condition of the unit 36, is arranged to that it faces frontally the free end 38 of the cylindrical member 30 of the button 14, in order that an axial movement of the button 14 brings the end 38 into contact with the micro-switch 39 to close the electric control circuit for driving the locking unit.

The sidewall 32 of the tubular portion 24 comprises connection means which include a plurality of tooth formations 34, three with reference to the figures, to allow fastening of the switch unit 36 on the body 18, which formations project radially from the wall 32 and are adapted to be snap engaged into corresponding seats 40 formed in the case of the switch unit 36, as a result of the axial insertion of the switch unit 36 on the tubular portion 24. Each seat 40 is delimited by a U shaped edge portion 42, spaced from the reminder of the case of the unit 36 by a pair of axial notches, in such a manner that the edge portions 42 can be pulled apart elastically as a result of the insertion of the body 36, in order to allow the teeth 40 to be engaged in the respective seats 42.

The correct insertion of the unit 36 is assured by the sliding engagement of an axial reference slot 43*a* of the case of the unit 36, along a tilted ramp 43 which extends between the tubular portion 24 and the bracket formation 25, which ramp 43 carries out a guide function for the axial movement of the unit 36 towards the base body 18.

A pair of bolts are provided to allow fastening of the base body 18 on the panel 12, each of which comprises a screw 60 and a respective check nut 61 that can be engaged on the stem of a screw 60 on the side of the panel 12 opposite to the base body 18. The head 62 of each screw 60 has a non-circular shape, for example a square shape, and is received in a seat 64 having a corresponding shape and made in the base body 18. A through hole 66 opens in each seat 64 to allow insertion of the stem of a respective screw 60, the circular edge of which being provided with a series of projections 68 intended to interfere with the stem of the screw 60 during the insertion thereof, in order to hold it in the axial direction by friction.

An eccentric centering formation 70 projects also from the surface of the base body 18 which faces the panel 12, for example having a cross shaped cross-section, which is intended to engage a corresponding seat formed in the panel 12 in a position adjacent to the opening 20.

The assembly of the device 16 takes place in the following manner. Firstly, the screws 60 are inserted in the holes 66 until their heads 62 engage the seats 64, the deformation of the projections 68 of the holes 66 which results from insertion of the screws 60 being such as to generate friction allowing the screws 60 to be held in place.

The button 14, which consists of the disc portion 13 and the cover member 15 already assembled beforehand, is associated with the base body 18 by arranging the O-ring 47 and the spring 46 between them, the latter being arranged inside the tubular portion 24 and in abutment on its bottom wall 26. Insertion of the button 14 into the body 18 ends when the end portion 38 of the cylindrical member 30 projects from the hole 28 of the wall 26. In this condition, the pins 52 are penetrated in the respective holes 54 of the body 18, after their heads 56 have undergone a radial contraction as a result of crossing the holes 54, and are gone back in their undeformed condition. In this manner, the pins 52 carry out a holding action of the button 14 with respect to the base body 18, as a result of the interference of the teeth 58 with the edges of the respective holes 54. The washer 51 and the snap ring 50 are then mounted on the free end of the element 30 projecting from the hole 28.

The unit formed by the button 14 and the base body 18 are therefore associated with the panel 12, by interposing the seal 21 between them, in such a manner that the tubular portion 24 and the bracket formation 25 of the appendage 22 of the body 18 are inserted in the opening 20, the centering formation 70 being arranged so as to engage the respective seat in the panel 12.

The switch unit 36 is inserted axially in the part of the tubular portion 24 projecting from the internal surface of the panel 12, until the snap engagement of the tooth formations 34 in the seats 40 of the case of the unit 36 is accomplished, as a result of the temporary deformation of the edge portions 42, the insertion of the unit 36 being guided by the sliding engagement of the axial slot 43*a* of the unit 36 along the tilted ramp 43.

In this condition, the check nut 61 can be screwed on the stems of the screws 60 in order to lock the device 16 from inside the panel 12, after that the female connector 37 can be coupled with the respective male connector.

A pressure applied by a finger of a user on the button causes the movement of the cylindrical member 30 with respect to the base body 18 against the elastic action of the spring 46, as well as the contact of the end 38 of the member 30 with the micro-switch 39, in order close the electric circuit for releasing the locking unit, so that opening of the panel 12 is made possible.

What is claimed is:

1. A release device, particularly for a motor vehicle door, comprising a base body intended to be applied on an outer face of the door and having an axial appendage which can be inserted in a corresponding opening of the door, said axial appendage including a tubular portion provided with a bottom wall having a hole intended to be slidably engaged by a cylindrical member projecting axially from a button associated with the base body with a possibility of a relative movement, the tubular portion being provided with a coupler adapted to allow a switch unit to be removably fastened to the door, which switch unit can be operated as a result of an axial movement of a free end of the cylindrical member of the button, wherein the button comprises a plate portion slidably associated with the base body by a series of pins which project from the plate portion and engage corresponding holes of the base body, each pin including an elastically deformable fork shaped head provided with stop teeth and having a diameter greater than the respective holes, so that insertion of the pins in the holes of the base body prevents removal of the button with respect to the base body.

2. The device according to claim 1, in which a circular groove is formed close to the free end of the cylindrical member of the button, for the insertion of a snap ring intended to lock the axial sliding of the button with respect to the bottom wall of the tubular portion.

3. The device according to claim 1, in which a shaped cover member is applied to an outer face of the button, which cover member is adapted to bear a symbol of the motor vehicle on which the device has to be installed.

4. The device according to claim 1, in which the button is biased towards a direction of removal with respect to the base body.

5. The device according to claim 4, in which a thrust spring is interposed between the bottom of said tubular portion and a shoulder of the button adjacent to the cylindrical member.

6. The device according to claim 1, in which said coupler allows connection of the switch unit to the base body, as a result of the insertion thereof in the tubular portion along an axial direction.

7. The device according to claim 6, in which said coupler is adapted to allow snap connection of the switch unit.

8. The device according to claim 7, in which said coupler comprises a plurality of tooth formations which project from the part of the sidewall of the tubular portion opposite to the base body with respect to the door, the switch unit having a series of corresponding seats for the engagement by said teeth, each of which is surrounded by an elastically deformable edge portion.

9. The device according to claim 1, in which a plurality of screws are associated with the base body in order to allow fastening thereof to the door, each screw having a non-circular shaped head adapted to engage a corresponding seat formed in the base body.

10. The device according to claim 9, in which each screw engages a through hole of the base body, the edge of which has a series of substantially deformable radial formations adapted to interfere with the stem of the screw in its condition inserted in the respective hole, in order to hold axially the respective screw by friction.

11. The device according to claim 9, in which at least one eccentric centering formation extends from the surface of the base body intended to face the outer face of the door, which is adapted to engage a corresponding seat of the panel.

12. A release device, particularly for a motor vehicle door, comprising a base body intended to be applied on an outer face of the door and having an axial appendage which can be inserted in a corresponding opening of the door, said axial appendage including a tubular portion provided with a bottom wall having a hole intended to be slidably engaged by a cylindrical member projecting axially from a button associated with the base body with a possibility of a relative movement, the tubular portion being provided with a coupler adapted to allow a switch unit to be removably fastened to the door, which switch unit can be operated as a result of an axial movement of a free end of the cylindrical member of the button, wherein a plurality of screws are associated with the base body in order to allow fastening thereof to the door, each screw having a non-circular shaped head adapted to engage a corresponding seat formed in the base body, in which each screw engages a through hole of the base body, the edge of which has a series of substantially deformable radial formations adapted to interfere with the stem of the screw in its condition inserted in the respective hole, in order to hold axially the respective screw by friction.

13. The device according to claim 12, in which a circular groove is formed close to the free end of the cylindrical member of the button, for the insertion of a snap ring intended to lock the axial sliding of the button with respect to the bottom wall of the tubular portion.

14. The device according to claim 12, in which at least one eccentric centering formation extends from the surface of the base body intended to face the outer face of the door, which is adapted to engage a corresponding seat of the panel.

15. The device according to claim 12, in which a shaped cover member is applied to an outer face of the button, which cover member is adapted to bear a symbol of the motor vehicle on which the device has to be installed.

16. The device according to claim 12, in which the button is biased towards a direction of removal with respect to the base body.

17. The device according to claim 16, in which a thrust spring is interposed between the bottom of said tubular portion and a shoulder of the button adjacent to the cylindrical member.

18. The device according to claim 12, in which said coupler allows connection of the switch unit to the base body, as a result of the insertion thereof in the tubular portion along an axial direction.

19. The device according to claim 18, in which said coupler is adapted to allow snap connection of the switch unit.

20. The device according to claim 19, in which said coupler comprises a plurality of tooth formations which project from the part of the sidewall of the tubular portion opposite to the base body with respect to the door, the switch unit having a series of corresponding seats for the engagement by said teeth, each of which is surrounded by an elastically deformable edge portion.

* * * * *